United States Patent [19]

Cunningham et al.

[11] Patent Number: 4,581,254

[45] Date of Patent: Apr. 8, 1986

[54] FOAM APPLICATOR USED IN PAPER TREATMENT

[75] Inventors: Charles J. Cunningham, Elkview; Russell L. Brown, Charleston, both of W. Va.

[73] Assignee: Union Carbide Corporation, Danbury, Conn.

[21] Appl. No.: 715,201

[22] Filed: Mar. 22, 1985

[51] Int. Cl.[4] ..... B05C 3/02; B05C 3/12; B05D 3/02; B05D 5/00

[52] U.S. Cl. ..... 427/244; 68/200; 118/410; 118/411; 118/419; 427/296; 427/356; 427/373

[58] Field of Search ..... 118/410, 411, 419; 68/200; 156/578, 78; 239/590, 590.3, 590.5, 597; 427/296, 244, 356, 373

[56] References Cited

U.S. PATENT DOCUMENTS

| | | | |
|---|---|---|---|
| 4,023,526 | 5/1977 | Ashmus et al. | 118/410 |
| 4,081,318 | 3/1978 | Wietsma | 162/157 R |
| 4,158,076 | 6/1979 | Wallsten | 427/294 |
| 4,348,251 | 9/1982 | Pauls et al. | 156/500 |

*Primary Examiner*—Michael R. Lusignan
*Attorney, Agent, or Firm*—Henry H. Gibson

[57] ABSTRACT

Foam applicators having specific lip configurations and substrate orientation, used for applying foamed treating compositions to substrates, including rapidly moving paper, provide uniform distribution of treating agent onto the substrate.

12 Claims, 2 Drawing Figures

FOAM APPLICATOR USED IN PAPER TREATMENT

BACKGROUND OF THE INVENTION

1. Field of the Invention

The invention pertains to apparatus and processes used in treating paper, and more particularly to foam applicators used to apply foamed treating compositions to moving paper web, such as during papermaking and finishing operations.

2. Description of Background Information

The application of foamed treating compositions to substrates has been achieved using various techniques. Foam applicators used to apply foamed treating compositions to a substrate are described in U.S. Pat. No. 4,023,526 (Ashmus et al.). The Ashmus et al. patent describes foam applicators which may be selected from a broad range of nozzle configurations, which can be used to treat any porous substrate such as textile fabric or a non-woven material, paper, leather or wood veneer. The foam applicator described in the Ashmus et al. patent provides for the application of treating agent in a foamed composition enabling low wet pickup, i.e. reduced deposition of liquid, such as water, onto the treated substrate. The Ashmus et al. patent is directed primarily towards, and all the specific embodiments involve, treatment of textile fabric.

Textile fabrics are air permeable to a relatively high degree, which property facilitates the separation air from liquid in a foam stream at contact with the fabric for textile. In contrast, many paper materials such as unfinished writing papers, book papers, newsprint, linerboard, boxboard, containerboard, and the like, are substantially non-porous being relatively low in permeability. Such papers are also, in comparison to textiles, relatively low in absorbency and very low in absorbency rate of liquids. The relatively low level of absorbency and particularly the low rate of liquid absorbency presents serious difficulties in obtaining suitable treating agent distributions from foamed compositions, particularly at high rates of treatment, such as those used in commercial papermaking and finishing operations.

It has been discovered that foam applicators as broadly described in the Ashmus et al. patent are limited in their ability to provide for the uniform distribution of foamed treating composition onto substantially non-porous paper webs at high processing speeds.

Other techniques for applying foamed treating compositions to paper have been developed. U.S. Pat. No. 4,081,318 (Wietsma) describes the application of foamed treating compositions to paper webs passing through the screening area of paper making machines using suction to draw a foam on to the web. The Wietsma system is designed to apply the foam to the paper without touching it or compressing it in any way by direct mechanical contact. Another no-contact type of foam applicator is described in U.S. Pat. No. 4,348,251 (Pauls et al.). U.S. Pat. No. 4,158,076 (Wallsten) describes a process and apparatus for applying foamed treating compositions to paper web whereby uniform distribution of treating composition onto the paper is achieved using a foam application zone having an opening in, or upstream of, the area where foam contacts the paper.

There is therefore a need for a foam applicator and process for treating paper which provide for uniform application of a broad selection of paper treating agents using fluid treating compositions which may vary over a wide range of composition viscosity, actives concentration and the like, and be applicable to a variety of paper webs including non-porous paper, moving at relatively high processing speeds, such as in-process papermaking and finishing operations.

SUMMARY OF THE INVENTION

This invention pertains to a foam applicator and process for treating paper. The foam applicator comprises, in combination, the following components. The foam applicator has a base. An upstream lip and a parallel downstream lip both extend angularly from the base. A foam application chamber extends between interior walls of each lip and is enclosed at each end by end walls. One or more openings in the base provide movement of a uniform distribution of foam into the chamber from foam generation means. The upstream lip has top inside and outside edges. The downstream lip has a top outside edge and a rim between the top outside edge and the interior wall of the downstream lip. An Angle A is formed by the inside edge and the interior wall of the upstream lip. An Angle B is formed by the outside edge and the interior wall of the downstream lip. An orifice extends between the top inside edge of the upstream lip and the rim of the downstream lip and effects application of the foam to a substrate contacting the lips and passing across the orifice. Angle A is greater than 90°. Angle B is less than 90°. The upstream lip extends farther from the base than the downstream lip.

The process for treating paper comprises the following essential steps. A first step comprises (1) producing a fast-breaking, fast-wetting, limited stability foam of a liquid treating composition. A second step comprises (2) passing the foam through one or more openings in a base of a foam applicator providing a uniform distribution of the foam to a foam application chamber extending between interior walls of an upstream lip and a parallel downstream lip both extending angularly from the base. The chamber is enclosed at each end by end walls. A third step comprises (3) passing a paper web across and contacting the lips along a top edge of the upstream lip and along a rim between a top outside edge and the interior wall of the downstream lip. The paper web approaches the upstream lip at an upstream entrance Angle C away from perpendicular. The paper web leaves the upstream lip at an upstream exit Angle D away from perpendicular and towards the base. The paper web approaches the downstream lip at a downstream entrance Angle E away from the interior wall of the downstream lip. The paper web leaves the downstream lip at a downstream exit Angle F away from the direction of approach from the downstream lip. Angle C is greater than or equal to 0°. Angle D is greater than 0°. Angle E is greater than 90°. Angle F is greater than or equal to 0°. A fourth step comprises (4) appyling a controlled amount of the foam to the surface of the paper web providing a uniform distribution of the liquid treating composition on the paper web.

DETAILED DESCRIPTION OF THE INVENTION

This invention provides a foam applicator and process for treating paper which enable the uniform distribution of treating compositions onto substrates, such as paper webs during high speed papermaking and finishing operations. The applicator and process of this invention are applicable to a wide range of paper treating agents and webs, including substantially non-porous paper webs, providing a low rate of liquid absorbency and are effective under typical papermaking and finishing operations including high rates of paper processing.

An illustrative embodiment of the foam applicator of this invention is shown in the figures. It is noted that the figures are not drawn to scale but provide schematic representations of embodiments facilitating discussion and understanding of this invention.

Dimensional orientation as used in the context of this invention, unless otherwise indicated, is such that length is measured along the direction of paper movement and across the foam applicator lips, width is measured across the paper web and along the foam applicator lips and height is measured in terms of the direction perpendicular to the paper sheet.

Figure 1:
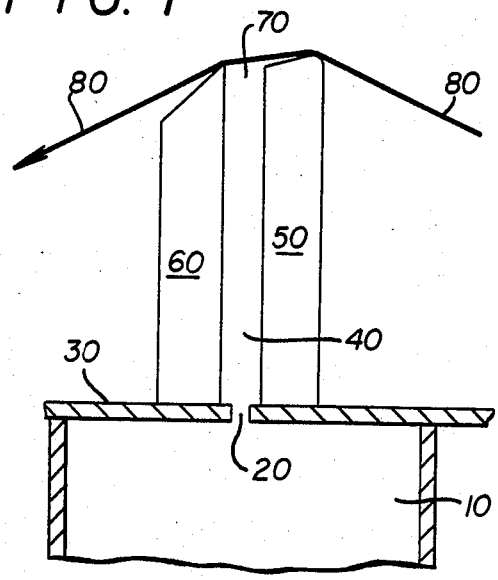
FIG. 1 is a schematic end view illustrative of a foam applicator of this invention used in the process of this invention.

Referring to FIG. 1 of the drawings, foamed treating composition produced from foam generation means not shown in the drawings, is provided to a foam distribution chamber 10. The particular type of foam generation means is not critical but may be any commercially available machine, such as the well known axial, radial or static types, which provide uniform foams. The purpose of the foam distribution chamber 10 is to provide a uniform distribution of foam having a cross sectional shape, usually introduced as round, into an essentially rectangular shape having a width which approximates the width of substrate to be treated. The specific design of the foam distribution chamber is not critical so long as the foam distribution chamber 10 functions to provide a uniform flow of foam across the entire width of the foam stream at the top of the foam distribution chamber 10. A representative distribution chamber which may be used in this invention is described in U.S. Pat. No. 4,237,818 (Clifford et al.).

One or more openings 20 in a base 30 provide movement of the uniform distribution of foam into a foam application chamber 40. The widths along the openings 20 in base 30 and the foam application chamber 40 are approximately equal to the width of the foam distribution chamber 10 at base 30. The specific height of the openings 20 is not critical, but should preferably be about as thin as normal construction practices permit. The purpose of the base 30 having one or more openings 20 is to develop a small pressure drop between the foam distribution chamber 10 and the foam application chamber 40 thereby promoting uniform distribution of foam flow throughout the foam application chamber 40.

The foam application chamber 40 extends between an upstream lip 50 and a parallel downstream lip 60 both extending angularly from the base 30. The foam proceeds through the foam application chamber 40 to orifice 70 at the end of the foam application chamber distant from base 30, at which orifice 70 the foam contacts the substrate 80. When the foam contacts the moving substrate at the orifice 70, the foam reverts to liquid providing a uniform distribution of liquid treating composition on the substrate.

Figure 2:
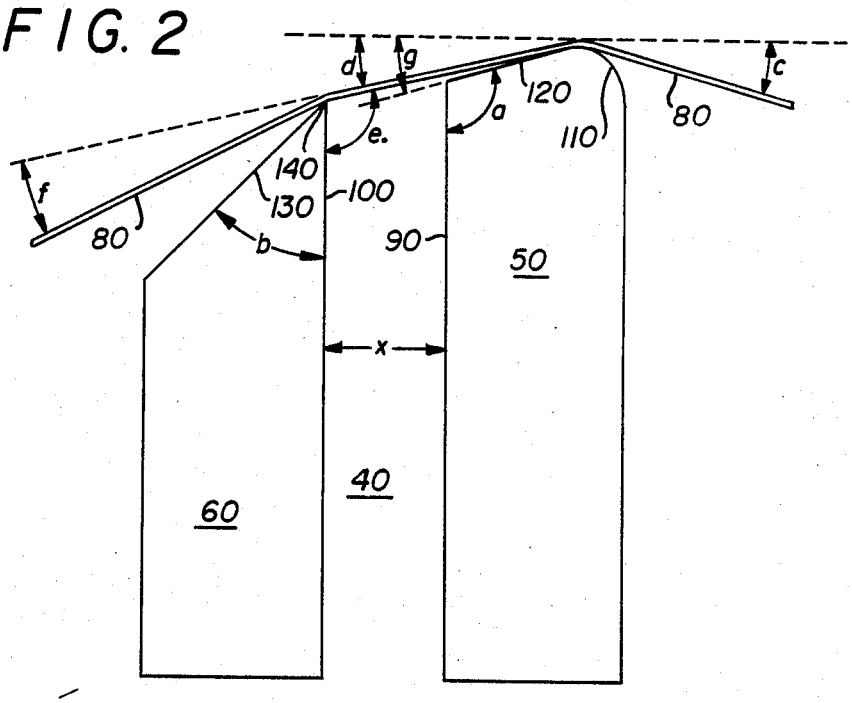
FIG. 2 is a schematic end view showing relative positions of the applicator lips and paper as well as angular relationships within and between the components.

Referring to FIG. 2 there is shown an expanded view of the foam applicator in FIG. 1. The foam application chamber 40 extends between interior wall 90 of the upstream lip 50 and interior wall 100 of the downstream lip 60, being enclosed at each end by end walls, not shown. An end outside edge 110 and end inside edge 120 define the end of the upstream lip 50 away from the base 30. An end outside edge 130 and a rim 140 between the end outside edge 130 and the interior wall 100 define the end of the downstream lip 60 away from the base 30.

An Angle A is formed by the intersection of the inside edge 120 and the interior wall 90 of the upstream lip. A relief Angle B is formed by the intersection of the outside edge 130 and the interior wall 100 of the downstream lip. Angle A is greater than 90°, preferably from about 91° to about 135°, and most preferably from about 105° to about 125°. Angle B is less than 90°, preferably from about 1° to about 70°, and most preferably about 45°. As can be seen in the drawings, the end of upstream lip 50 extends farther from the base 30 than does the end of the downstream lip 60.

The edges of the upstream lip 50 and the downstream lip 60 in contact with the substrate may be of any selected configuration, while maintaining the previously described orientations. The edges may be pointed, tapered, flat, beveled, arched or otherwise curved. To the extent that the interior wall 90 or the inside edge 120 of the upstream lip, or the interior wall 100 or the outside edge 130 of the downstream lip, are curved surfaces, Angles A or B are defined by the intersection of lines extended from the flat portion of such surfaces. If no flat portion exists for such surfaces, Angles A and B are defined by the intersection of lines extending from the midpoint of the curve intersecting such surfaces to the end of the surface furthest from the intersection. It is preferred that the length of rim 140 of the downstream lip 60 be either sharp or of similar narrow configuration.

In the process of this invention, paper substrate 80 moves across the foam applicator, in a direction shown as from right-to-left in the drawings. The paper 80 is in contact along the entire end width of the upstream lip 50 covering the intersection between the end outside edge 110 and end inside edge 120. The paper 80 is also in contact along the entire end width of the downstream lip 60. These contacts are sufficient to form a seal over orifice 70 extending between the upstream lip 50 and the downstream lip 60. This seal is provided by a combination of substrate tension and the configuration defined by the substrate passing across the applicator lips 20 and 30.

An upstream entrance angle, Angle C, at which the substrate 80 approaches the upstream lip 50 away from perpendicular (shown by the horizontal dotted line in FIG. 2) is from greater than or equal to 0° up to less than 90°, preferably greater than 0° to about 60°, and most preferably greater than from about 15° to about 45°. An upstream exit angle, Angle D, at which the substrate 80 leaves the upstream lip 50 away from perpendicular and towards the base 30 is between 0° and 90°, preferably up to about 50°, and most preferably from about 1° to about 25°. A downstream entrance angle, Angle E, at which the substrate 80 approaches the downstream lip 60 away from the interior wall 100 of the downstream lip 60 is from between 90° and 180°, preferably up to about 140°, and most preferably from about 91° to about 115°. A downstream exit angle, Angle F, at which the substrate 80 leaves the downstream lip 60 away from the direction of approach to the upstream lip 60 (shown by the dotted line extension in FIG. 2) is from greater than or equal to 0° up to less than 90°, preferably up to about 60°, and most preferably from about 15° to about 45°. The sum of Angles E and F is less than 180°.

As can be seen in FIG. 2, the upstream entrance Angle D defines in angular terms how far the upstream lip 50 extends farther from the base 30 than does the downstream lip 60.

The upstream lip 50 has a relief Angle G defined by the extent to which the end inside edge 120 slopes away from perpendicular and towards the base 30. As such the upstream lip relief Angle G equals the value of the upstream lip Angle A minus 90°. The upstream lip relief Angle G is at least equal to, preferably greater than, and most preferably from about 1° to 30° greater than, the upstream exit Angle D.

The length of the foam application chamber 40, shown by x in FIG. 2, which is the distance traveled by the substrate 80 passing over orifice 70, is not critical, but may be any value greater than 0. Preferably, x is from about 1/64 to about 2, and most preferably from about $\frac{1}{8}$ to about $\frac{3}{4}$, inches. The length x of the foam application chamber 40 influences the pressure of foam applied to the substrate, which also depends on the foam density, the foam application rate, and the rate the paper passes across the foam applicator.

The height of the lips 50 and 60 above the base 30 is not critical, but should be sufficient to minimize uncontrolled turbulence of foam within the foam application chamber 40. Typically, the average height of the lips 50 and 60 range from about 5 to about 40, preferably from about 6 to about 20, times the length of the foam application chamber 40.

In operation, as in the process of this invention, a positive pressure above ambient develops within the foam application chamber 40. This pressure may be monitored using pressure sensing devices, such a manometer or pressure gauge, which is connected to the foam application chamber 40. The amount of pressure is that which is sufficient to provide for the deposition of fluid treating composition onto the moving substrate. The amount of pressure will depend upon various factors including foam density, rate of foam flow, rate of substrate motion, absorbency of the substrate and the porosity of the substrate. This positive pressure, i.e., greater than 0, will generally range from about 0.01 to about 10, preferably from about 0.1 to about 3.0, and most preferably from about 0.3 to about 1, psi.

The class of paper webs treated by this invention pertains to all paper sheet materials, including particularly paper produced in wet-laid papermaking operations. The process of this invention is particularly suitable to substantially non-porous paper relatively low in permeability. Illustrative paper webs include non-porous paper such as unfinished writing paper, book paper, newsprint, linerboard, boxboard, containerboard and the like, as well as porous paper such as tissue, filtration grade paper and the like. The paper web may have any level of moisture content from dry up to near saturation.

Although this invention is described in the context of paper treatment, the scope of the claims to this invention would extend to those substantially equivalent, fibrous sheet materials which due to low porosity, low wettability and high speed treatment would be benefitted by the uniform distribution of treating agent using the foam applicator or process of this invention.

Liquid treating compositions used in the process of this invention consist essentially of paper treating agent and liquid vehicle. The composition will usually have a foaming agent. The paper treating agent is the active material which is distributed onto the paper web. The liquid vehicle is generally required as a carrier to assist in the deposition of the paper treating agent onto the paper web. The paper treating agent may be provided in the liquid vehicle in any form, such as by dispersion, emulsification, solvation, or other means known in the art.

The paper treating agent used in the process of this invention pertains to the class of materials recognized by those skilled in the art as having utility when applied to paper. Typical paper treating agents include functional and performance chemical additives for paper, such as product performance and process performance chemicals. Illustrative paper treating agents include sizing aids such as starches, casein, animal glue, synthetic resins including polyvinyl alcohol and the like materials which may be applied to the pulped slurry or to the formed sheet; binders, including wet strength or dry strength resins, such as polymers and copolymers of acrylamide, acrylonitrile, polyamide, polyamine, polyester, styrene, ethylene, acrylic acid, acrylic esters and materials such as rosin, modified, gums, glyoxal and the like; coloring agents including dyes such as the class of direct, reactive and fluorescent dyes and pigments such as titanium dioxide or the like whitening agents, or organic color types commonly used to color paper; oil or water repellants; defoamers to the extent the foaming agent is not rendered inoperative; fillers; slimicides; latex; saturants; wax emulsions; and the like. Blends of more than one paper treating agents may be used.

The concentrations of paper treating agent is not critical so long as an effective amount is provided to the paper web to provide treated paper having the desired properties, based on well-established practices in the art. The particular concentration of paper treating agent desired will vary depending upon the particular type of paper treating agent, rate of foam application, rate of moving paper, paper properties and the like considerations, which determine the amount of paper treating agent desired on the treated paper. The concentration of paper treating agent in the fluid treating composition is usually from about 1 wt. % to about 70 wt. %, preferably from about 2 wt. % to about 50 wt. %, and most preferably from about 4 wt. % to about 30 wt. % paper treating agent in the liquid vehicle.

The particular type of liquid vehicle is not critical so long as it performs the function of assisting deposition of the paper treating agent onto the paper web. Illustrative liquid vehicles include water, organic solvents and the like materials which are compatible with paper, and preferably papermaking or finishing operations. Water is the preferred liquid vehicle.

The liquid treating composition used in the process of this invention will usually contain a foaming agent in an amount effective to provide a foam having the requisite structure. In some instances the paper treating agent may possess sufficient foaming properties to provide the requisite foam structure. In such cases the paper treating agent is also the foaming agent so that the presence of added foaming agent is not essential. The particular type of foaming agent is not critical but may be selected from the class of foaming agents recognized by those skilled in the art as capable of forming the requisite foam. Typically, foaming agents are surfactants, i.e.

surface active agents, which will operate to provide the requisite foam characteristics.

Illustrative foaming agents include (1) nonionic or anionic surfactants, such as: ethylene oxide adducts of long-chain alcohols or long-chain alkyl phenols, such as mixed $C_{11}$–$C_{15}$ linear secondary alcohols containing from about 10 to 50, preferably from about 12 to 20, ethyleneoxy units, $C_{10}$–$C_{16}$ linear primary alcohols containing from about 10 to about 50, preferably from about 12 to 20, ethyleneoxy units, $C_8$–$C_{12}$ alkyl phenols containing from about 10 to about 50, preferably from about 12 to about 20, ethyleneoxy units; fatty acid alkanolamides, such as coconut fatty acid monoethanolamide; sulfosuccinate ester salts, such as disodium N-octadecylsulfosuccinate, tetrasodium N-(1, 2-dicarboxyethyl)-N-octadecylsulfosuccinate, diamyl ester of sodium sulfosuccinate acid, dihexyl ester of sodium sulfosuccinic acid, dioctyl ester of sodium sulfosuccinic acid, and the like; or (2) cationic or amphoteric surfactants, such as: distearyl pyridinum chloride; N-coco-beta-aminopropionic acid (the N-tallow or N-lauryl derivatives) or the sodium salts thereof; stearyl dimethyl benzyl ammonium chloride; the betaines or tertiary alkylamines quaternized with benzene sulfonic acid; or the like. Such foaming agents are well known and any similar surfactant can be used in addition to those previously identified. Blends of more than one foaming agent may be used. In selecting the foaming agent for a particular foam, care must be exercised to use those agents which will not unduly react with the other agents present or interfere with the foaming or treating process.

Additional adjuvants may optionally be provided to the fluid treating composition consistent with those procedures established in the art, including wetting agents, foam stabilizers such as hydroxyethyl cellulose or hydrolyzed guar gum; heat sensitizers; setting agents; dispersants; screening agents; antioxidants; to the extent that such adjuvants do not unduly affect the desired foam properties or application of treating agent to the paper web. The concentration of foaming agent and adjuvants which may be provided follows those practices established in the art.

The particular sequence of addition of components in the treating composition is not critical, but may be achieved by mixing a liquid vehicle, paper treating agent, foaming agent, and other optional additives in any desired sequence, following those practices in the art.

The foam used in this invention contains gas and liquid treating composition. The gas is required as the vapor component of the foam. The gas may be any gaseous material capable of forming a foam with the liquid treating composition. Typical gas materials include air, nitrogen, oxygen, inert gases, or the like. Air is the preferred gas.

The relative proportion of liquid treating composition to gas is not critical beyond that amount effective to provide the required, uniform foam structure in the foam applicator.

Preferred foams which may be provided are fast-breaking, low-wetting, and have limited stability. Such foams are fast-breaking having limited stability in that the foam reverts substantially immediately to liquid upon contact with the substrate. Such foams are low-wetting in that relatively low amounts of liquid vehicle are applied to the substrate. Such foams have a uniform structure in that the treating composition, including paper treating agent, is evenly distributed throughout the foam.

The foam preferably has a density, bubble size and half-life as described in U.S. Pat. No. 4,099,913 (Walter et al.), incorporated herein by reference. Typically, the density of the foam can range between about 0.005 to about 0.8, preferably 0.01 to about 0.6, grams per cubic centimeter. The foams generally have an average bubble size of between 0.05 to about 0.5, and preferably 0.08 to about 0.5, millimeters in diameter. The foam half-life is generally from about 1 to about 60, preferably from about 3 to about 40, minutes.

Preferred foams which may be provided are described in U.S. Pat. No. 4,099,913 (Walter et al.), incorporated herein by reference. Particularly preferred foams are described in cofiled U.S. patent application Ser. No. 715,169 (Brown et al.), entitled "Foam Compositions Used in Paper Treatment", incorporated herein by reference.

The foam is produced by foam generation means known to those skilled in the art, as described previously. Foam generation means generally consist of a mechanical agitator capable of mixing metered quantities of gas and liquid treating composition. The foaming is controlled by adjusting the volume of gas introduced into the foaming apparatus and the rotation rate of the rotor in the foaming apparatus. The rotation rate is significant in providing a foam that would have the desired bubble size and half-life. The relative feed rates of the liquid composition and gas will determine the density of the foam. Once generated, the foam passes to the foam applicator and is applied to the paper substrate as previously described. The temperature at which the foam is produced and applied is not critical but may range from ambient up to 100° C. or more in cases where the liquid treating composition is heated prior to or during application to the substrate.

The rate at which the substrate passes across the foam application nozzle may vary over a wide range, including those ranges typical in papermaking and finishing operations. Typically, the substrate will be supplied at a rate of at least about 200, preferably from about 400 to about 6000, and most preferably from about 500 to about 3500, feet per minute.

The temperature conditions at which the fluid treating composition is produced and applied to the paper web are not critical but follow the practices established in the art. Typically, the temperature may range from ambient up to 100° C. or more in cases where the paper treating agent is heated prior to and/or during application.

Single or multiple foam applicators and steps may be provided. Foam may be applied to either or both sides of the paper web. In multiple or two-sided applications, each foam applicator may be supplied with the same or different foam treating composition produced in one or more foamed generation means. In multiple or two-sided applications the amount and composition of the applied foam may be equal or different among the various applications. Multiple foam application steps may be in direct succession or separated by other process steps, as may be used in papermaking operations.

The substrate passing across the foam applicator may be assisted by appropriate guide means to form the requisite contact along the applicator lips. Guide means may be provided either upstream, downstream, or both, of the foam applicator. Typical guide means include paper rolls, nips, bars, or similar devices effective in assisting the substrate to contact the lips across the entire width of the substrate. A preferred guide means is a vacuum powered holding device, preferably immediately preceding the upstream lip, described in cofiled U.S. patent application Ser. No. 715,170 (Brown et al.), entitled "Vacuum Guide Used in Flexible Sheet Material Treatment", incorporated herein by reference.

The fluid applicator and process of this invention are preferably applied to continuous treating operations, typical in papermaking and finishing operations.

In a typical embodiment a metered quantity of liquid treating composition is foamed with a metered quantity of gas in a commercially available foam generation means. The foam is passed, using appropriate conveying means, to a foam distribution chamber of a foam applicator. The foam passes through one or more openings in the base of the foam applicator to provide a positive pressure and uniform distribution of foam in a foam application chamber, extending between interior walls of an upstream lip and a parallel downstream lip which extend angularly from the base of the foam applicator. The upstream lip has an end inside edge intersecting the interior wall at an angle greater than or equal to 90°. The downstream lip has an end outside edge intersecting the interior wall at a downstream relief angle less than 90°. A paper web is passed across the foam applicator, usually assisted by guide means, providing contact between the paper along the entire width of a top edge of the upstream lip and along the entire width of a rim between between a top outside edge and the interior wall of the downstream lip. The paper web approaches the upstream lip at an upstream entrance angle at zero or more degrees away from perpendicular and leaves the upstream lip at a positive upstream exit angle away from perpendicular and towards the base. The paper web approaches the downstream lip at a downstream entrance angle greater than 90° away from the interior wall of the downstream lip, and leaves the downstream lip at a downstream exit angle of zero or more degrees from the direction of approach to the downstream lip. A controlled amount of the foam is applied to the surface of the paper web passing across the orifice of the foam application chamber providing a uniform distribution of the treating composition on the paper web.

The following examples are illustrative of some embodiments of this invention, and are not intended to limit the scope thereof.

EXAMPLES

The designations used in the examples have the following meaning:

| Designation | Description |
|---|---|
| Foaming agent I | n-dodecyl amido betaine. |
| Foaming agent II | Sodium dodecylbenzene sulfonate. |
| Foaming agent III | Sodium lauryl sulfate. |
| Foaming agent IV | Dodecyl benzene sulfonic acid. |
| Tracer I | Acid red dye distributed under the tradename Tectilon ® Red 2B by Ciba Geigy Corp. |
| Tracer II | Fluorescent dye distributed under the tradename Leucophore ® AC by Sandoz Colors & Chemicals Co. |
| Tracer III | Nylon blue dye distributed under the tradename Supernylite ® Brilliant Blue by Crompton & Knowles Co. |
| Treating agent I | Oxidized starch distributed under the tradename Stayco ® -M by A. E. Staly Mfg. Co |
| Treating agent II | Hydroxyethyl cellulose having a viscosity grade QP-100M distributed under the tradename Cellosize ® by Union Carbide Corp. |
| Treating agent III | Hydroxyethylated starch distributed under the tradename Penford ® Gum 280 by Penick & Ford Inc. |

Unless otherwise indicated the following general procedure was used in the examples. Liquid treating composition was prepared by mixing, in the designated proportions, the designated components including paper treating agent or agents, foaming agent, tracer and water. The tracer was a dye utilized to enable visual inspection of the treated paper to determine uniformity in the application of treating composition. Metered quantities of the liquid treating composition and air were fed to a commercially available foaming apparatus, Model No. 8MHA Oakes Mixer to generate a foam having the designated density. The foam was conveyed to a foam distribution chamber in a foam applicator nozzle having the structure designated in the examples.

The designated paper web was fed at the designated paper speed to the foam applicator with the paper contacting the entire width of end edges of the applicator lips. The paper passed over the upstream lip at the designated upstream entrance Angle C and upstream exit Angle D, and passed over the downstream lip at the designated downstream entrance Angle E and downstream exit Angle F, as defined previously. Unless indicated otherwise the fluid treating composition was produced and applied under ambient temperature conditions. The applied amount of liquid treating composition, in wet-coat weight, and paper treating agent, in dry-coat weight, are also designated. The treated paper was then recovered by collecting on a take up roll.

All viscosities were determined by using a Brookfield Model RVF viscometer at the appropriate spindle and speed following standard practice.

Example Control A

In this example a liquid treating composition containing cooked starch as paper treating agent was applied to a paper sheet using the procedure set forth above employing a foam applicator as described in U.S. Pat. No. 4,023,526 (Ashmus et al.). The foam applicator consisted of an application chamber and a nozzle, having a width about equal to the paper width. Foam entered the application chamber from the foam generation means through a conduit 0.5 inch in diameter. The application chamber was about 9 inches high and had an exit slot to the nozzle measuring 9 inches wide by approximately 0.5 inches long, i.e., as measured in the direction of paper movement. The nozzle was of similar width and length measuring about 1.5 inches high. The nozzle had flat lips in contact with the paper web from about 0.5 to about 1.0 inches long. The applicator lip Angles A and B were both 90°.

The following liquid treating composition was prepared by cooking an aqueous solution containing 20 wt. % starch at about 200° F. for over 30 minutes, followed by adding the foaming agent and the tracer. The composition was then diluted to 10 wt. % starch with tap water.

| | |
|---|---|
| Treating agent I | 10 wt. % |
| Foaming agent I | 1.5 wt. % |
| Tracer I | 0.13 wt. % |
| Water | 88.37 wt. % |

This composition was then foamed and fed through the previously described foam applicator to a continuously moving sheet of vellum grade paper. The paper weighed about 89.6 g/m$^2$ and was internally but not externally sized. The application conditions used were as follows:

| | |
|---|---|
| Foam density | 0.060 g/cc |
| Paper speed | 100 ft/min |
| Wet coat weight | 21.1 g/m$^2$ |
| Dry coat weight | 2.1 g/m$^2$ |
| Applicator gap, x | 0.125 in |
| Application pressure | 0.25 psi |
| Angle C | 20° |
| Angle D | 0° |
| Angle E | 15° |
| Angle F | 20° |
| Angle G | 0° |

Visual inspection of the treated paper sheet showed excellent uniformity of coverage as evidenced by the tracer distribution. This example demonstrates that uniform distribution of foamed treating compositions are provided by foam applicators of the prior art for relatively low substrate speed applications.

Example Control B

In this example the general procedure, foam applicator, liquid treating composition and paper as in Example Control A were repeated, except that the starch concentration was raised to 20 percent, providing a composition having a Brookfield viscosity of 180 cps. and the paper speed was raised providing the following conditions:

| | |
|---|---|
| Foam density | 0.060 g/cc |
| Paper speed | 500 ft/min |
| Wet coat weight | 10.5 g/m$^2$ |
| Dry coat weight | 2.1 g/m$^2$ |
| Foam Pressure | 0.54 psi |

While the entire paper web was treated, a distinct small pattern of covered and uncovered areas was noticeable as shown by the tracer. This example points out the limitations in treating paper webs at elevated process speeds using foam applicators having lips of equal height and having long, flat end edges.

Example Control C

In this example Example Control B, was repeated except that the liquid treating composition contained no starch. The uniformity of application, as evidenced by the distribution of tracer, was excellent. This example when compared with the previous Example Control B demonstrates that the presence of treating agent, such as starch, in a foam composition influences the uniformity of application attainable in high speed, paper web treatment.

Example Control D

In this example a liquid treating composition of cooked starch was prepared as described in Example Control A with the following ingredients:

| | |
|---|---|
| Treating agent I | 16.7 wt. % |
| Coloring agent II | 0.025 wt. % |
| Foaming agent II | 0.50 wt. % |
| Water | 82.725 wt. % |

The previously described general procedures were used under the following operating conditions:

| | |
|---|---|
| Foam density | 0.40 g/cc |
| Paper speed | 1500 ft/min |
| Wet coat weight | 10.8 g/m$^2$ |
| Dry coat weight | 1.8 g/m$^2$ |
| Applicator gap, x | 0.25 in |
| Foam pressure | 0.37 psi |
| Temperature at application | 170° F. |

The design of the foam applicator was as in Example Control A except that the applicator lip configurations were changed so that the end edges of the lips were reduced in length to about 0.375 inch for the upstream lip and to about 0.125 inch for the downstream lip, and angle E was changed to 90°.

As evidenced by the distribution of the tracer, a coating was obtained which was overall uniform on a macroscopic level, but on close inspection showed an "orange peel" or micro non-uniformity. This example demonstrates the influence of the length and configuration of the applicator lip "flats" or end edges on the uniformity of application.

Example 1

In this example a liquid treating composition of starch was prepared as in Example Control A with the following ingredients:

| | |
|---|---|
| Treating agent I | 18.0 wt. % |
| Tracer II | 0.025 wt. % |
| Foaming agent I | 2.0 wt. % |
| Water | 79.975 wt. % |
| Viscosity | 70 cps |

The composition was applied using the same procedure and to the same type paper as described in Example Control D except that the foam temperature at application was ambient. The foam applicator used was similar to the device in Example Control A with the modification that the downstream lip was provided with an end having a sharp-edged rim between the top outside edge and interior wall of the lip and the downstream lip was shortened so that the paper approached the downwstream lip at a downstream entrance Angle E of 115°. The specific operating conditions were as follows:

| | |
|---|---|
| Foam density | 0.082 g/cc |
| Paper speed | 800 ft/min |
| Wet coat weight | 10.0 g/m$^2$ |
| Dry coat weight | 1.8 g/m$^2$ |
| Applicator gap, x | 0.125 in |

-continued

| | |
|---|---|
| Foam pressure | 2.17 psi |

As evidenced by the distribution of the tracer, the application was very uniform and smooth. This example demonstrates the importance of the applicator lip design and paper orientation in obtaining uniform applications from foam composition for treating paper webs at high speeds.

Examples 2–4, E–J

In this example, a series of runs using a variety of applicator lip configurations were conducted using the paper, operating conditions, and foam applicator set forth in Example Control A, using the following liquid treating composition:

| | |
|---|---|
| Treating agent II | ~0.05 wt. %[a] |
| Foaming agent III | 1 wt. % |
| Tracer III | 1 wt. % |
| Water balance | (~97.75 wt. %) |

[a]in an amount sufficient to develop a Brookfield viscosity of about 50 cps

The configurations and settings of the foam applicator lips were varied and the uniformity of application observed, as set forth in Table I. In the Control Examples E–J, one or more of the lip configuration angles or paper orientation angles, as identified by an asterisk (*) in Table I, fell outside the operative range of values.

TABLE I

Treating Application Quality Using Various Nozzle Configurations and Paper Orientations

| Examples | Lip Angles A | Lip Angles B | Paper Angles C | Paper Angles D | Paper Angles E | Paper Angles F | Paper Angles G | Uniformity of Distribution |
|---|---|---|---|---|---|---|---|---|
| E | 105° | −45° | 52° | 15° | 45°* | 61° | 15° | Uneven streaks |
| F | 105° | 45° | 13° | 24° | 82°* | 20° | 15° | None, leaks |
| G | 105° | 45° | 34° | 24° | 82°* | 43° | 15° | Stripes |
| H | 105° | 15° | 40° | 45° | 90°* | 61° | 15° | Uneven |
| I | 75°* | 45° | 42° | 32° | 122° | 44° | −15°* | Spots, streaks |
| J | 95–105° | 45° | 40° | 11° | 101° | 31° | 5–15°* | Streaks |
| 3 | 110° | 45° | 41° | 17° | 107° | 41° | 20° | Smooth |
| 4 | 120° | 45° | 45° | 24° | 114° | 44° | 30° | Smooth |
| 5 | 110° | 45° | 45° | 9° | 99° | 41° | 20° | Smooth |

*outside operative range

These examples demonstrate preferred design parameters of the foam applicator and process of this invention which provide smooth, uniform coatings on paper from foam treating compositions.

Example 5

In this example two foam applicators as described in Example 1 were set in a supporting framework such that uniform applications of fluid treating compositions were made to both sides of a moving sheet of internally sized paper weighing about 89.6 grams per square meter.

The liquid treating composition used contained:

| | |
|---|---|
| Treating agent I | 16.7 wt. % |
| Tracer II | 0.025 wt. % |
| Foaming agent I | 2.3 wt. % |
| Water | 80.975 wt. % |

The foam from a single foam stream was divided equally and fed to two foam applicators, one set to the top side and one set to the bottom side of the paper. The operation conditions used were:

| | |
|---|---|
| Foam density | 0.25 g/cc |
| Paper speed | 800 ft/min |
| Wet coat weight | 10.8 g/m$^2$ each side for a total of 21.6 g/m$^2$ |
| Dry coat weight | 1.8 g/m$^2$ each side for a total of 3.6 g/m$^2$ |
| Applicator gap | 0.125 in each |
| Foam pressure | greater than zero (not measured) |

As evidenced by the distribution of the tracer, the liquid composition was distributed evenly on each side or surface of the paper. This example demonstrates that uniform applications to both sides of a paper web are attainable in a single application step using two foam applicators of this invention.

Example 6

In this example the composition described in Example 5 was applied to one side of the paper as described in Example 5 moving at a rapid rate using a single foam applicator under the following conditions:

| | |
|---|---|
| Foam density | 0.38 g/cc |
| Paper speed | 2300 ft/min |
| Wet coat weight | 7.5 g/m$^2$ |
| Dry coat weight | 1.25 g/m |
| Applicator gap, x | 0.125 in |

Excellent coating uniformity was obtained as evidenced by the distribution of the tracer. This example demonstrates uniformity of application achievable at very high paper web speeds.

Example 7

In this example the procedure and foam applicator as in Example 6 were used for light weight sheet of non-internally sized paper to apply liquid treating composition containing:

| | |
|---|---|
| Treating agent III | 4 wt. % |
| Foaming agent I | 1 wt. % |
| Tracer II | 0.025 wt. % |
| Water | 94.975 wt. % |

The operating conditions used were:

| | |
|---|---|
| Foam density | 0.06 g/cc |
| Paper speed | 500 ft/min |
| Paper weight | 47.1 g/m$^2$ |
| Wet coat weight | 5 g/m$^2$ |
| Dry coat weight | 0.2 g/m$^2$ |
| Foam pressure | 1.8 psi |

Observation of the tracer indicated that the application was uniform and smooth throughout the treated paper. This example demonstrates that light weight applications can be made to light weight unsized paper.

Example 8

In this example, a hot starch solution was applied to a pre-heated paper sheet to simulate typical in-process conditions for sizing a paper sheet on a paper machine.

Hot water was circulated through the jackets of a starch composition pot, the foam generator and the foam delivery line to the foam applicator. Temperature sensing devices were placed at appropriate locations in the foam stream and mixtures of steam and water were used to provide the desired temperature of liquid treating composition and foam.

A roll of 89.6 g/m$^2$ internally sized paper was pre-heated in a Despatch® hot air oven for sufficient time to develop a uniform temperature content of 160° F. A liquid treating composition was prepared by normal cooking procedures with the following ingredients:

| | |
|---|---|
| Treating agent I | 16.7 wt. % |
| Tracer II | 0.025 wt. % |
| Foaming agent I | 2.0 wt. % |
| Water | 81.275 wt. % |

Following cooking, the starch solution was maintained at 170° F. temperature. The solution was foamed at 170° F. in the foam generator and delivered through the foam applicator as used in Example 2 at 170° F. to the paper sheet which had been pre-heated to 160° F. The operating conditions used were:

| | |
|---|---|
| Foam density | 0.36 g/cc |
| Paper speed | 1200 ft/min |
| Wet coat weight | 10.8 g/m$^2$ |
| Dry coat weight | 1.8 g/m$^2$ |
| Foam pressure | 3.6 psi |
| Application temperature | 170° F. |

The distribution of tracer, was observed to provide smooth and uniform application of composition throughout the treated paper. This example demonstrates that the process and foam applicator of this invention have widespread and practical utility in papermaking operations including typical raised temperature operating conditions.

Example 9

In this example, a cooked starch composition was prepared in the normal manner as described in Example 2 except that the liquid treating composition was allowed to retrograde to a higher viscosity prior to application. The liquid treating composition used contained the following ingredients:

| | |
|---|---|
| Treating agent I | 12 wt. % |
| Tracer II | 0.025 wt. % |
| Foaming agent I | 2.0 wt. % |
| Water | 85.975 wt. % |
| Viscosity (Brookfield) | 1000 cps |

The foamed composition was applied to a sheet of internally sized paper weighing about 89.6 g/m$^2$ under the following conditions:

| | |
|---|---|
| Foam density | 0.085 g/cc |
| Paper speed | 1200 ft/min |
| Wet coat weight | 15.0 g/m$^2$ |
| Dry coat weight | 1.8 g/m$^2$ |
| Foam pressure | 2.0 psi |
| Application gap, x | 0.125 in |

A uniform distribution of treating composition was observed. This example, in combination with the previous examples, demonstrates the capability of the foam applicator and process of this invention to provide uniform distribution of treating compositions, substantially independent of the viscosity of the treating composition.

Example 11

In this example, a cooked starch composition was prepared as in Example Control A, using the following ingredients:

| | |
|---|---|
| Treating agent I | 12 wt. % |
| Tracer II | 0.05 wt. % |
| Foaming agent IV | 0.5 wt. % |
| Water | 87.45 wt. % |

The composition was applied to internally sized paper weighing 89.6 g/m$^2$ using the previously described general procedure and a foam applicator as described in Example 2 under the following operating conditions:

| | |
|---|---|
| Foam density | 0.32 g/cc |
| Paper speed | 1500 ft/min |
| Paper weight | 89.6 g/m$^2$ |
| Wet coat weight | 10.8 g/m$^2$ |
| Dry coat weight | 1.8 g/m$^2$ |
| Foam pressure | 0.7 psi |
| Application gap, x | 0.50 in |

Observation of the tracer indicated uniform application of treating composition throughout the treated paper. This example, in combination with the previous examples, demonstrates that improved application of treating composition is achieved relatively independent of the foam applicator nozzle gap, i.e., the length of the foam application chamber and orifice, in the direction of substrate movement.

We claim:

1. A foam applicator comprising, in combination:
(a) a base;
(b) an upstream lip and a parallel downstrip lip both extending angularly from the base;
(c) a foam application chamber extending between interior walls of each lip and enclosed at each end by end walls;
(d) one or more openings in the base providing for movement of a uniform distribution of foam into the chamber from foam generation means;
(e) top inside and outside edges of the upstream lip;
(f) a top outside edge of the downstream lip;
(g) a rim between the top outside edge and the interior wall of the downstream lip;
(h) an upstream lip relief Angle A formed by the inside edge and the interior wall of the upstream lip;
(i) a downstream lip relief Angle B formed by the outside edge and the interior wall of the downstream lip;
(j) an orifice extending between the top inside edge of the upstream lip and the rim of the downstream lip effecting application of the foam to a substrate passing across the orifice; wherein,
(k) Angle A is greater than or equal to 90°;
(l) Angle B is less than 90°; and
(m) the upstream lip extends farther from the base than the downstream lip.

2. The foam applicator of claim 1 wherein the substrate is paper.

3. The foam applicator of claim 1 wherein angle A is from about 91° to 135° and angle B is from about 1° to about 70°.

4. The foam applicator of claim 3 wherein angle A is from about 105° to about 120° and angle B is about 45°.

5. The foam applicator of claim 1 wherein the foam application chamber and orifice are from about 1/64 to about 2 inches across, as measured in the direction of paper movement.

6. The foam applicator of claim 5 wherein the foam application chamber and orifice are about 0.1 to about 0.75 inches across.

7. A process for treating paper comprising:

(1) producing a fast-breaking, fast-wetting, limited stability foam of a liquid treating composition;

(2) passing the foam through one or more openings in a base of a foam applicator providing a uniform distribution of the foam to a foam application chamber extending between interior walls of an upstream lip and a parallel downstream lip both extending angularly from the base, with the chamber enclosed at each end by end walls;

(3) passing a paper web across and contacting the lips along a top edge of the upstream lip and along a rim between a top outside edge and interior wall of the downstream lip; wherein the paper web:

(i) approaches the upstream lip at an upstream entrance angle C away from perpendicular;

(ii) leaves the upstream lip at an upstream exit angle D away from perpendicular and towards the base;

(iii) approaches the downstream lip at a downstream entrance angle E away from the interior wall of the downstream lip; and (iv) leaves the downstream lip at a downstream exit angle F away from the direction of approach to the downstream lip;

wherein:

angle C is greater than or equal to 0°;

angle D is greater than 0°;

angle E is greater than 90°;

angle F is greater than or equal to 0°; and (4) applying a controlled amount of the foam to the surface of the paper web providing a uniform distribution of the treating composition on the paper web.

8. The process of claim 7 wherein angle C is from about 1° to about 60°, angle D is from about 1° to about 50°, angle E is from about 91° to about 140° and angle F is from about 1° to about 60°.

9. The process of claim 8 wherein angle C is from about 15° to about 45°, angle D is from about 1° to about 25° C., angle E is from about 91° to about 115° and angle F is from about 15° to about 45° C.

10. The process of claim 7 wherein a paper guide is positioned immediately upstream or downstream, or both, of the foam applicator, which guide assists in providing contact between the paper and the upstream and downstream lips of the foam applicator.

11. The process of claim 10 wherein the paper guide is a vacuum holding device.

12. The process of claim 7 wherein the foam has a density of from about 0.005 to about 0.8 grams per cubic centimeter, an average bubble size of from about 0.05 to about 0.5 millimeters in diameter and a foam half-life from about 1 to about 60 minutes.

* * * * *